United States Patent [19]

Hvizd, Jr. et al.

[11] 4,361,723

[45] Nov. 30, 1982

[54] INSULATED HIGH VOLTAGE CABLES

[75] Inventors: Andrew Hvizd, Jr., Oxford; Richard T. Pye, Middlebury, both of Conn.

[73] Assignee: Harvey Hubbell Incorporated, Orange, Conn.

[21] Appl. No.: 244,053

[22] Filed: Mar. 16, 1981

[51] Int. Cl.[3] ..... H01B 4/02

[52] U.S. Cl. ..... 174/102 SC; 174/105 SC; 174/106 SC; 174/120 SC; 174/127

[58] Field of Search ..... 174/73 SC, 102 R, 102 SC, 174/105 SC, 106 SC, 120 R, 120 SC, 120 SR, 127, 121 SR

[56] References Cited

U.S. PATENT DOCUMENTS

| | | | |
|---|---|---|---|
| 3,287,489 | 11/1966 | Hvizd, Jr. | 174/102 SC |
| 3,433,891 | 3/1969 | Zysk et al. | 174/120 R |
| 3,828,115 | 8/1974 | Hvizd, Jr. | 174/102 SC X |
| 3,885,085 | 5/1975 | Bahder et al. | 174/120 SC X |
| 4,032,381 | 6/1977 | Eager, Jr. et al. | 174/120 R |
| 4,079,191 | 3/1978 | Robertson et al. | 174/121 SR |
| 4,132,858 | 1/1979 | Anderson et al. | 174/120 SR |

*Primary Examiner*—Volodymyr Y. Mayewsky

*Attorney, Agent, or Firm*—Jerry M. Presson; Robert H. Berdo

[57] ABSTRACT

There is provided an insulated high voltage cable which possesses the property of lower dielectric losses than prior art cables. The cable comprises a conductor insulated with at least two laminar layers of insulating material. At least one of the layers is relatively thick and has a low SIC. At least one other of the layers has a high SIC and is in contact with a surface of the low SIC layer. The high SIC layer is relatively thin and has a tan δ/SIC value no greater than 0.005 over a temperature range of 40° to 90° C.

11 Claims, 7 Drawing Figures

INSULATED HIGH VOLTAGE CABLES

BACKGROUND OF THE INVENTION

1. Field of the Invention

The present invention relates to improved insulated high voltage cables. More particularly, this invention relates to an improvement in cable design which will reduce dielectric losses within the total cable construction.

2. Description of the Prior Art

Ordinary insulated cables that are designed to carry high power loads, e.g., 2000 to 130,000 volts, are subject to a serious drawback in that imperfections and especially imperfections which are voids are apt to occur between the conductor and the insulation and between the insulation and outer shield. The electrical degradation which occurs at these imperfections is manifested by ionization and possibly other electrical phenomenon and results in a rapid breakdown of the insulation at these imperfection points. The breakdown is manifested by severe dielectric losses or complete failure of the insulation through the so-called "treeing" phenomenon.

U.S. Pat. No. 3,287,489 to Hvizd, Jr., the disclosure of which is incorporated herein by reference, describes a means for combatting the disadvantages associated with conventional insulated cables by insulating the conductor of a high voltage cable with a laminar insulating material of specific construction. The laminar insulation includes a thick layer of insulation material of low specific inductive capacity (hereinafter SIC), e.g., within the range of about 2 to about 4.5, and a thin layer of insulating material of high SIC, e.g., within the range of about 10 to about 25.

Thus, according to the teachings of the Hvizd, Jr. '489 patent, there is provided an insulated high voltage cable comprising a central core of metal of high conductivity and an outer metallic shield. Laminar insulation is located between the core and the shield. Such laminar insulation includes a thick layer of insulating material of low specific inductive capacity and a thin layer of insulating material of high specific inductive capacity covering at least one face of the thick layer of low specific inductive capacity insulating material.

The explanation of the property of "high" SIC, and an SIC value increasing with increasing temperature, lies in a basic characteristic of certain polymers known as "dipole moment." Certain polymers contain polar molecules which exhibit a dipole moment. This polymer structure characteristic is well known and is due to a particular type of atom or group of atoms, such as a halogen, having a charge, and being so arranged spatially to allow movement in an alternating current field. A measure of the effect of an element or group's dipole moment in an AC field has been referred to loosely as "molecular friction," an indication of which is SIC and power factor. Thus, hydrocarbon polymers without polar molecules have a "low" SIC, e.g., less than 4 at room temperature, and are temperature stable. Those polymers containing polar molecules have a high room temperature SIC (4 to 12) and are not stable with increasing temperature, i.e., some have a positive temperature coefficient and some a negative temperature coefficient.

The Hvizd, Jr. '489 patent did not assign values to the power factor or tan δ of the insulation layers as this was considered a property that was related to the SIC in formulating the insulation composition. In fact, the tan δ/SIC ratio of the insulation layers disclosed in that patent over the operating temperature range fell between 0.006 and 0.022. This can result in dielectric losses in the high SIC layers approaching and exceeding the loss in the primary insulation, depending on the primary insulation used and its relative thickness compared to the normally thinner high SIC layers. Dielectric losses increase the wattage losses in the cable and thereby increase the cost of transmitting electrical power. Although the dielectric losses for a short length of cable may not be highly significant, in applications which require the cable to have lengths in excess of one mile, these losses are cumulative over the cable length and can significantly affect the feasibility of a particular cable for such applications from a cost standpoint.

SUMMARY OF THE INVENTION

It has now been found that dielectric losses can be considerably reduced in an insulated high voltage cable by insulating the conductor of a high voltage cable with at least two laminar layers of insulating material. At least one layer of insulating material is relatively thick and has a low SIC. At least one other layer of insulating material, which is in contact and interfaces with a surface of the low SIC layer is relatively thin and has a high SIC and a tan δ/SIC ratio of no greater than 0.005 and, preferably, less than 0.004, over an operating temperature range of from about 40° to about 90° C. Further, it is preferred that the dielectric strength of the insulating material comprising the high SIC layer have a value not less than the quotient of (1500/SIC) volts per mill, when the SIC value is 7 or greater. It is also preferred that the tan δ/SIC have a negative temperature coefficient over the range of 20° through 150° C. This invention provides the insulation on the cable with protection against concentrated electrical energy or voltage stress at any one point that could become a failure, prematurely shortening the life of the cable; while not significantly adding to the dielectric losses of the cable.

DETAILED DESCRIPTION OF THE INVENTION

The terminology used herein is conventional in the high voltage cable art. SIC is also known as the dielectric constant. The term "conducting material" applies to resistivities below 0.001 ohm-cm. and the term "semiconducting material" applies to resistivities in the range of 1 to 1,000,000 ohm-cm. The term "insulating material" applies to resistivities over $10^{10}$ ohm-cm.

Figure 1:
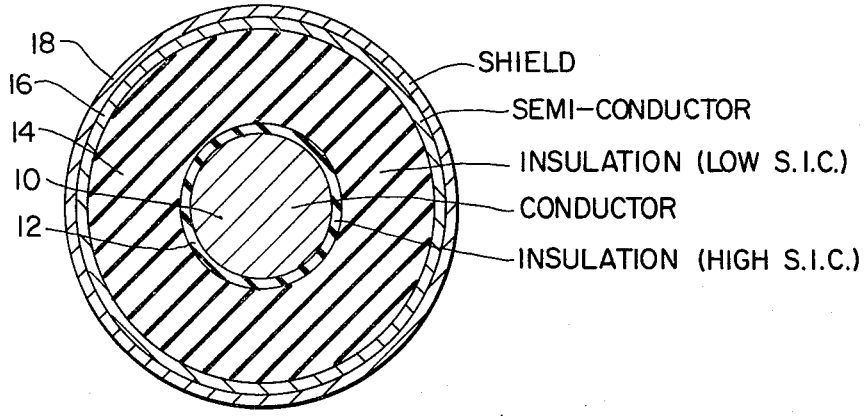
FIG. 1 is a cross section of a cable constructed in accordance with this invention.

The cable illustrated in FIG. 1 includes a conductor 10 composed of a conductive material such as copper or aluminum surrounded by a relatively thin, e.g., less than 50 mils in thickness, layer of insulation 12 which is made of an insulating material having a high SIC, e.g., in the range of from about 7 to about 150, and a tan δ/SIC value of 0.005 or less over a temperature range of from about 40° to about 90° C. An example of such a material is a hydrocarbon polymer containing a polar molecular due to the presence of a moiety such as chlorine, vinyl acetate or acrylonitrile, to which has been added between 25 to 35 parts per hundred weight of polymer (pph) of carbon black that has high carbon structure and a fine particle size. It is preferred to use ASTM type 358 carbon black. Polymers that may be used include a crosslinkable polyethylene compound, such as Bakelite HFDE-4201; and polyvinyl chloride alloy type compounds such as Geon 8720, Tenneco 2920 and 2921 and Pantasote No. 1149 (a polyvinyl chloride-ethylene vinyl acetate graft copolymer). Care must be taken in adding the carbon black so as to avoid making the material semiconductive. Depending on the nature of the carbon black and/or polymer, conductivity may result at, or above 35 pph of carbon black. To function in the intended manner, the mixture must still be classed as insulating, not conducting. The polymer and carbon black are combined in an internal mixer, such as a Banbury, utilizing a mixing time of about 8 to 10 minutes. Maximum batch temperature for a polyvinyl chloride should reach 300°-325° F. The batch temperature of crosslinkable polyethylene should not be allowed to exceed 260° F. A specific formulation which may be used will now be described.

To a No. 9 size steam heated Banbury internal mixer there are added about 238 lbs. of Geon 8720 and 82 lbs. of a high-structure carbon black. The Geon 8720 is fluxed prior to the addition of the carbon black. The carbon black is added slowly to allow time for incorporation into the plastic rather than being added all at once. The procedure for mixing is as follows:

| Time Min. | |
|---|---|
| 0 | Add resin, apply ram pressure. |
| 2 | Float ram, add carbon black slowly. |
| 4–5 | Apply full ram pressure. |
| 5.5 | Raise ram and sweep excess carbon into batch. |
| 6 | Apply full ram pressure. |
| 7 | Raise ram and sweep thoroughly. |
| 10–12 | When mixing temperature (Banbury temperature chart) reaches 260° F., dump batch. |

The compound is next converted to granule form for feeding into an extruder. It is also stored under low humidity conditions to avoid problems with moisture pickup by the carbon black. Once the granulated, dry compound is available, it is applied to a power cable stranded conductor, of copper or aluminum or over an insulated core, in a normal extrusion process following conventional procedures. This involves a crosshead-type extruder. The extruded product is quenched with cool water.

Surrounding the layer of insulation 12 is a relatively thick layer of primary insulation 14 made up of an insulating material having a low SIC, e.g., in the range of about 2 to about 4.5, such as a natural or synthetic rubber or a thermoplastic material such as an insulating grade of polyethylene. The respective layers 12 and 14 are incorporated onto the cable so as to get good physical contact between their facing surfaces. This can be conveniently done through known extrusion processes.

A semi-conductor 16 of conventional construction is wrapped around the insulation layer 14. The semi-conductor may be an extruded layer or it may consist of a cotton or other fabric tape impregnated with a material that will conduct electricity. The semi-conductor 16 is then covered with a conducting metallic shield 18 in known manner. This shield may comprise conducting elements, e.g., copper, aluminum or other metallic wire servings or metallic tapes helically or longitudinally applied.

Figure 2:
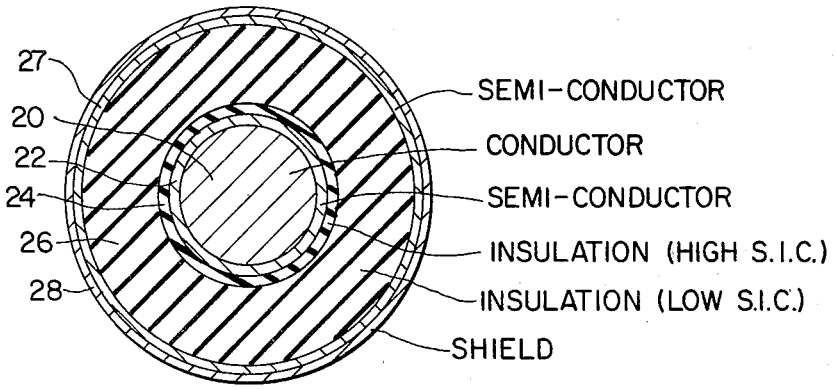
FIG. 2 is a cross section of a cable illustrating another embodiment of this invention.

The cable illustrated in FIG. 2 comprises a conductor 20 covered by a layer 22 of semi-conducting material, then by a relatively thin layer 24 of insulating material having a high SIC and a tan δ/SIC value of 0.005 or less over a temperature range of from about 40° to about 90° C. The layer 24 is covered with a relatively thick layer 26 of an insulating material having a low SIC. The layer 26 is covered with a layer 27 of semiconductor material which, in turn, is covered with a metallic shield 28 in conventional manner.

Figure 3:
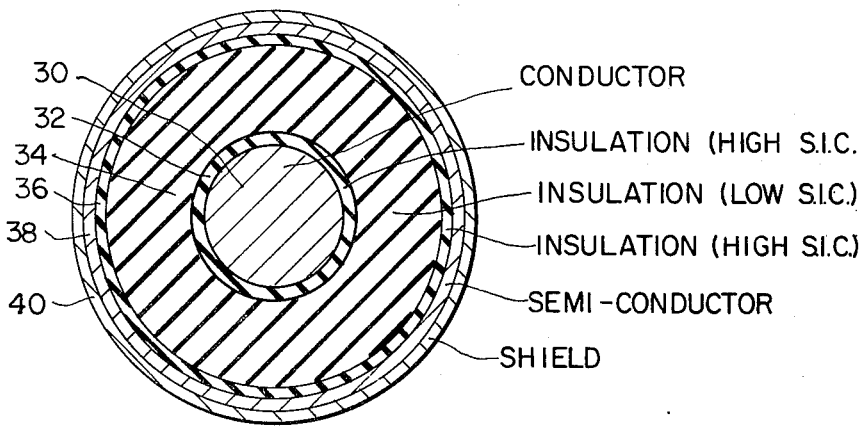
FIG. 3 is a cross section of a cable illustrating still a further embodiment of this invention.
Figure 4:
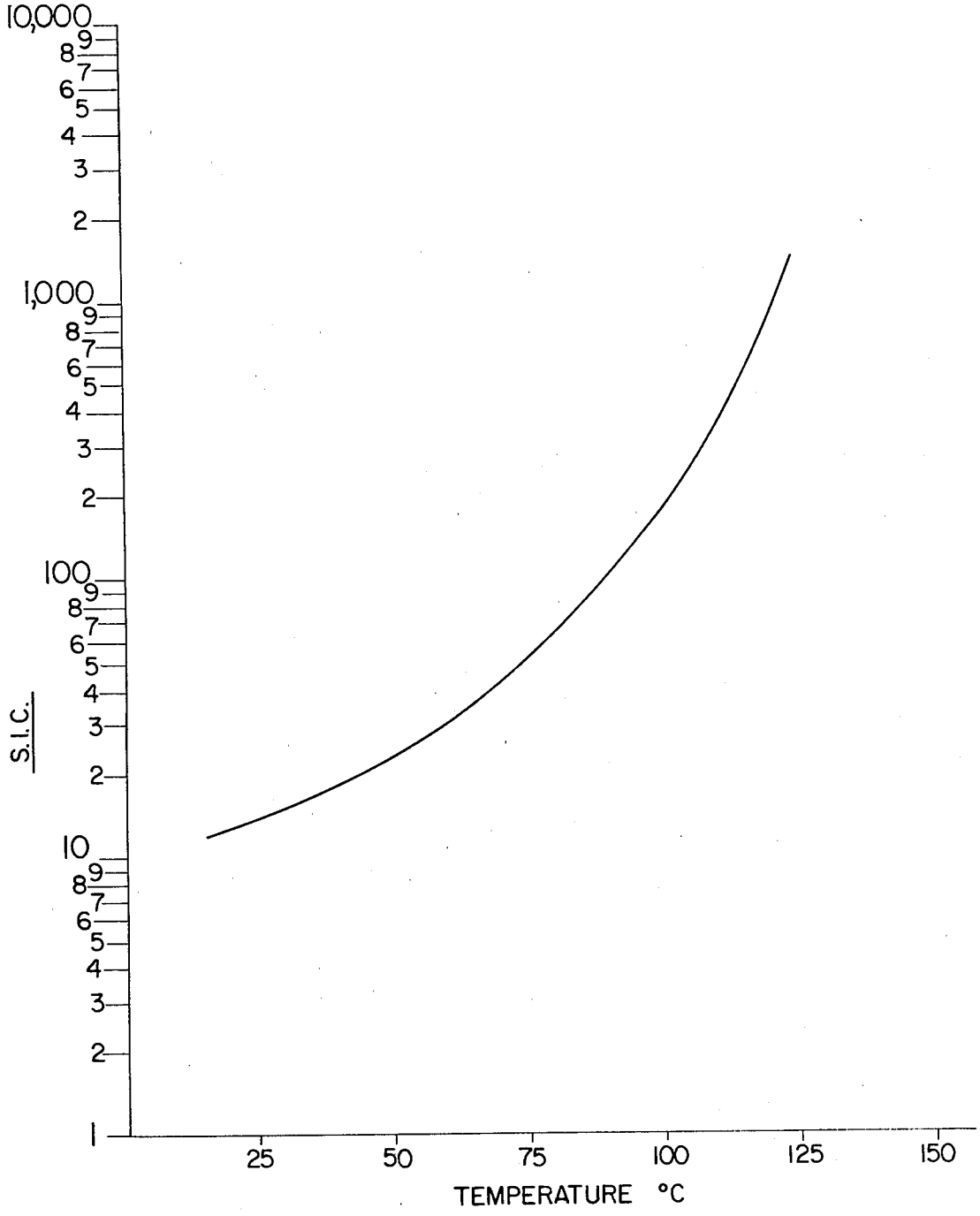
FIG. 4 PRIOR ART
FIGS. 4 and 5 are graphical representations of the behavior of SIC, tangent δ and the ratio (quotient) of tangent δ to SIC with varying temperature for the high SIC layers in the prior art insulation of the Hvizd, Jr. '489 patent.

The cable illustrated in FIG. 3 comprises a conductor 30 covered by a relatively thin layer 32 of insulating material having a high SIC and a tan δ/SIC value of 0.005 or less over a temperature range of from about 40° to about 90° C. The layer 32 is covered with a relatively thick layer 34 of insulating material having a low SIC. The layer 34 is covered with another relatively thin, e.g., no greater than 100 mils in thickness, layer 36 of insulating material having a high SIC and a tan δ/SIC value of no greater than 0.005 over a temperature range of from about 40° to 90° C. The layer 36 is covered with a layer 38 of semi-conducting material. The layer 38 is covered with a metallic shield 40 in known manner.

It is preferred that the ratio of the thickness of the layer of high SIC material to the thickness of the layer of the low SIC material to be less than about 0.3.

The cable constructions described with respect to FIGS. 1, 2 and 3 provide sufficiently low dielectric losses that special derating of cables is not required to account for such losses. In cables made in accordance with the prior art, i.e., wherein the high SIC insulation layer has a tan δ/SIC value of 0.02, conservatively considered, the dielectric losses affect cable ampacity ratings from 1.0 to 2.8%; whereas a cable made in accordance with this invention, i.e., wherein the high SIC insulation layer has a tan δ/SIC value of no greater than 0.005 over a temperature range of from about 40° to 90° C., dielectric losses affect cable ampacity ratings only 0.7 to 1.8%. Moreover, the resultant dissipation factor of a cable made in accordance with this invention is significantly reduced from 5.4–5.6% to 3.5–3.7% as compared to a prior art cable. With energy costs increasing, these reductions become increasingly more important, particularly since millions of feet of this type of cable are installed annually.

The relationship of the tan δ/SIC quotient of no greater than 0.005 over the normal operating temperature range of the cable (40° to 90° C.) can be favorably compared with the four times greater quotient of 0.02 with the prior art cable.

Figure 5:
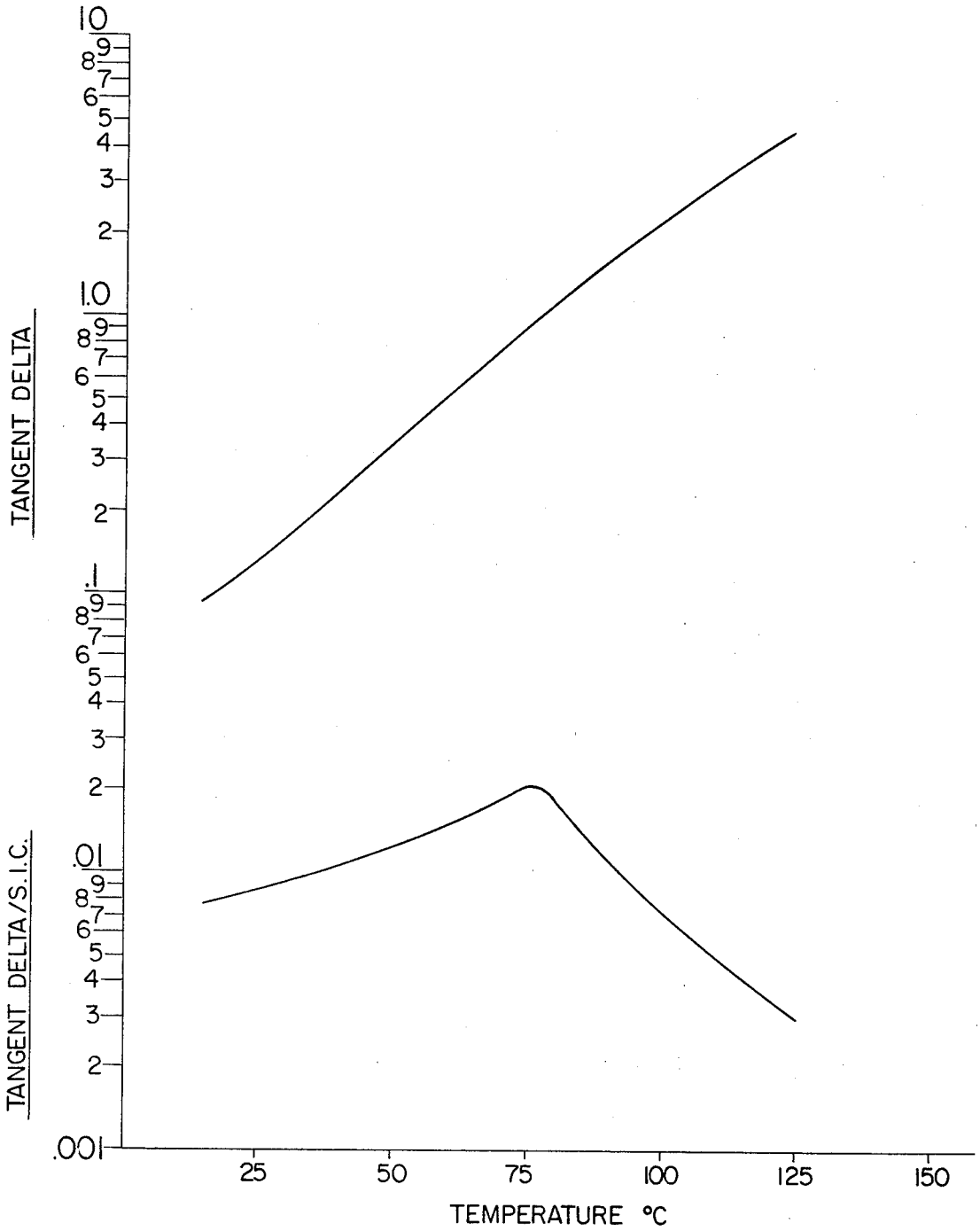
FIG. 5 PRIOR ART
Figure 6:
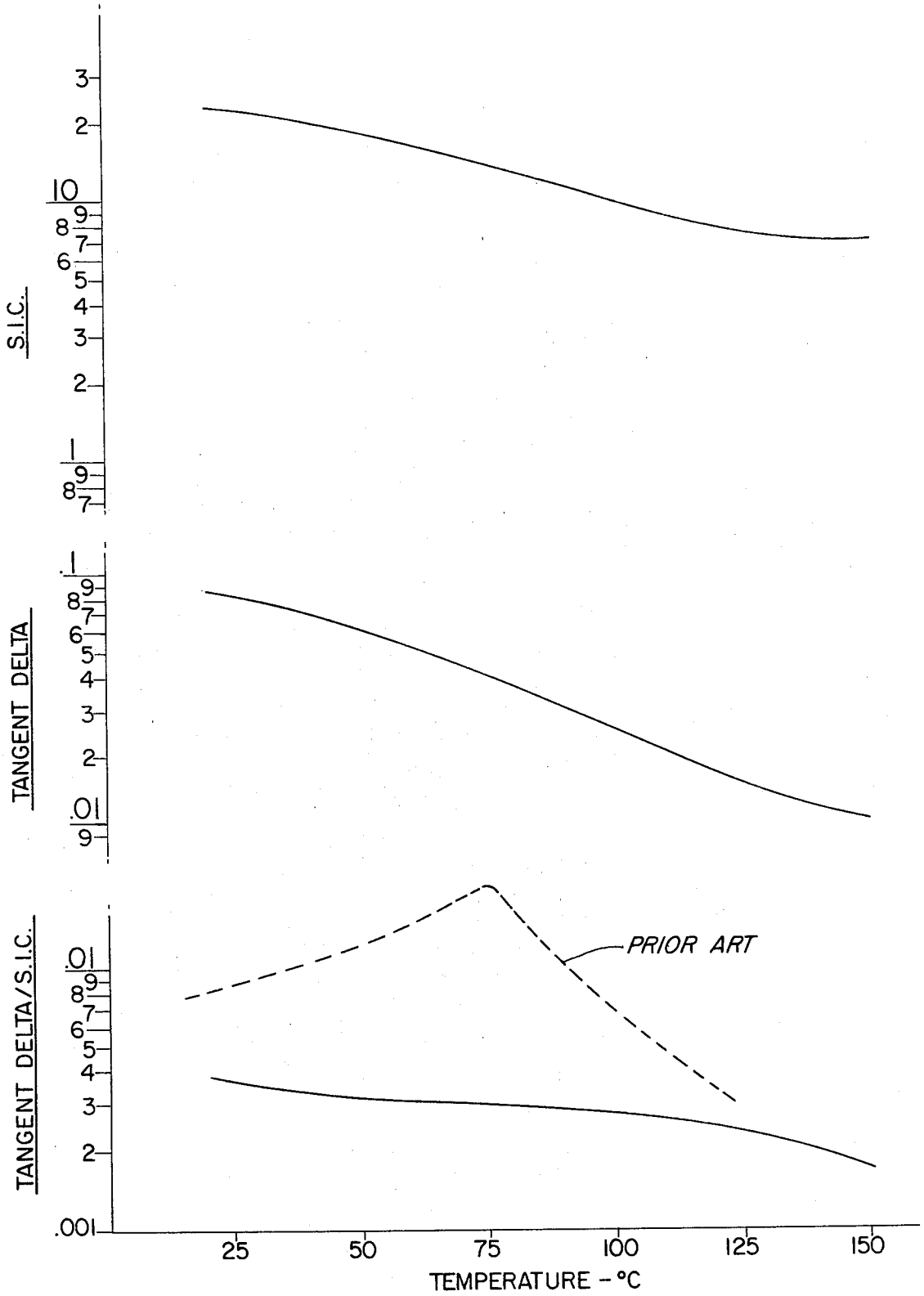
FIGS. 6 and 7 are graphical representations of SIC, tangent δ and the ratio of tangent δ to SIC with varying temperature for the high SIC layer in the insulation of the present invention.
Figure 7:
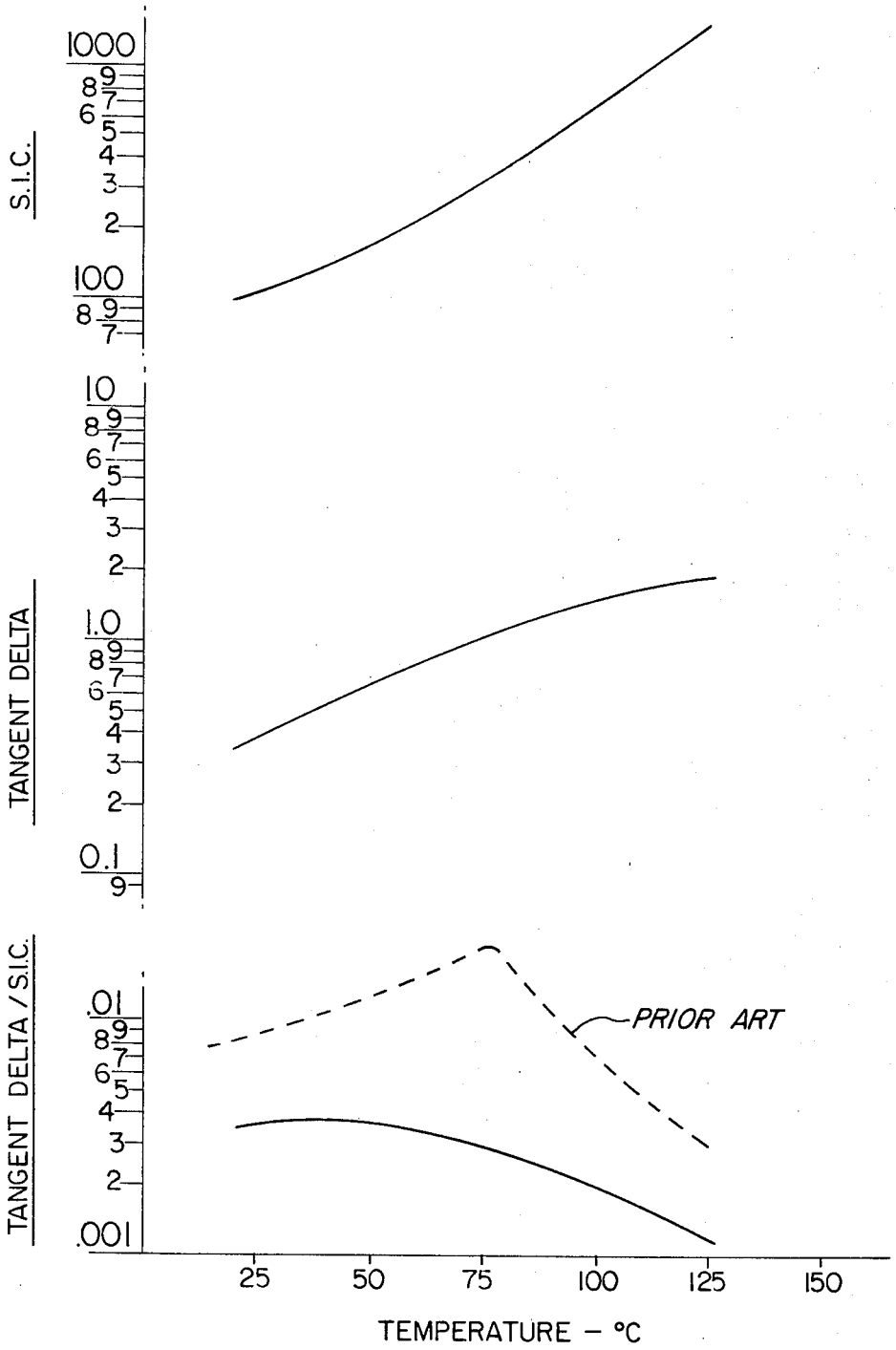

Referring now to FIGS. 4, 5, 6, and 7, FIGS. 4 and 5 are graphical representations of SIC, tangent δ and the tangent δ/SIC value with varying temperature for the high SIC layer in the prior art insulation of the Hvizd, Jr. '489 patent. The area under the curves is an indication of the amount of power lost in a cable. FIG. 6 is a graphical representation of this data for a high SIC insultion layer based on Union Carbide cross linkable polyethylene compound DFD 4201 with 35% by weight, based on the weight of the polyethylene, of N-358 type carbon black added. FIG. 7 is a graphical representation of this data for a high SIC insulation layer based on B. F. Goodrich Geon 8720, a polyvinyl chloride blend with acrylonitrile-butadiene polymer containing 30% by weight, based on the weight of the polymers, of N-358 type carbon black. For purposes of comparison the tan δ/SIC values at varying temperatures for the prior art insulation layer, i.e., the bottom curve of FIG. 5, is shown in dotted lines on each of FIGS. 6 and 7. The area between the two tan δ/SIC curves is an indication of the amount of power lost in a prior art cable construction which is not lost in a cable construction of this invention. The electrical characteristics shown in FIGS. 4, 5, 6, and 7 were measured on a shielded sample of #14(s) copper wire insulated with 0.030" of the compound. The test voltage used was 100 volts AC (60 Hz). The shield was isolated from ground. Measurements were made with a Tettex High Voltage Capacitance bridge. Wire samples were heated in a circulating oven.

We claim:

1. An insulated high voltage cable comprising a conductor insulated with at least two laminar layers of insulating material, at least one of said layers being relatively thick and having a low SIC of no greater than 4.5, at least one other of said layers having a high SIC of 7 or more and being in contact and interfacing with a surface of said low SIC layer, said high SIC layer being relatively thin and having a tan δ/SIC value no greater than 0.005 over a temperature range of 40° to 90° C.

2. A cable as defined in claim 1 wherein said conductor is coated with successive layers comprising a thin layer of high SIC material, a thick layer of low SIC material, a layer of semiconducting material and a layer of conductive material.

3. A cable as defined in claim 1 wherein said conductor is coated with successive layers comprising a layer of semiconducting material, a thin layer of said high SIC material, a thick layer of said low SIC material, a layer of semiconducting material and a layer of conductive material.

4. A cable as defined in claim 1 wherein said conductor is coated with successive layers comprising a thin layer of said high SIC material, a thick layer of said low SIC material, a thin layer of high SIC material having an SIC of 7 or greater, a layer of semiconducting material and a layer of conductive material.

5. A cable as defined in claim 1 wherein the SIC of the thick low SIC layer is in the range about 2 to about 4.5 and the SIC of the thin high SIC layer is in the range of about 7 to about 1500.

6. A cable as defined in claim 5 wherein the thick layer of insulation is crosslinked.

7. A cable as defined in claim 5 wherein the thick layer of insulation is thermoplastic.

8. A cable as defined in claim 5 wherein the thin layer of insulation is crosslinked.

9. A cable as defined in claim 5 wherein the thin layer of insulation is thermoplastic.

10. A cable as defined in claims 1 or 2 wherein said thin layer of insulation is less than 50 mils thick.

11. A cable as defined in claim 4 wherein the second recited thin layer of high SIC material is no greater than 100 mils thick.

* * * * *